US010617200B2

(12) United States Patent
Park et al.

(10) Patent No.: US 10,617,200 B2
(45) Date of Patent: Apr. 14, 2020

(54) COSMETIC DEVICE

(71) Applicant: L'OREAL, Paris (FR)

(72) Inventors: Woo Ram Park, Seoul (KR); Bradford Pistorio, Westfield, NJ (US)

(73) Assignee: L'OREAL, Paris (FR)

( * ) Notice: Subject to any disclaimer, the term of this patent is extended or adjusted under 35 U.S.C. 154(b) by 56 days.

(21) Appl. No.: 15/763,923

(22) PCT Filed: Aug. 17, 2016

(86) PCT No.: PCT/JP2016/074571
§ 371 (c)(1),
(2) Date: Mar. 28, 2018

(87) PCT Pub. No.: WO2017/061181
PCT Pub. Date: Apr. 13, 2017

(65) Prior Publication Data

US 2018/0279762 A1 Oct. 4, 2018

(30) Foreign Application Priority Data

Oct. 7, 2015 (JP) ..... 2015-199211

(51) Int. Cl.
*A46B 13/02* (2006.01)
*A46B 15/00* (2006.01)
(Continued)

(52) U.S. Cl.
CPC ..... *A46B 13/02* (2013.01); *A46B 7/04* (2013.01); *A46B 13/008* (2013.01);
(Continued)

(58) Field of Classification Search
CPC ..... H02P 1/00; H02P 6/00; H02P 1/42; H02P 23/00; H02P 27/00; H02P 21/00;
(Continued)

(56) References Cited

U.S. PATENT DOCUMENTS 7,024,717 B2 * 4/2006 Hilscher ..... A46B 5/0095 15/22.1
7,448,109 B2 * 11/2008 Brewer ..... A46B 15/0002 15/22.1
(Continued)

FOREIGN PATENT DOCUMENTS

CN 1460011 A 12/2003
CN 102058923 A 5/2011
(Continued)

OTHER PUBLICATIONS

International Search Report for PCT/JP2016/074571 dated May 12, 2016.
(Continued)

*Primary Examiner* — Antony M Paul
(74) *Attorney, Agent, or Firm* — The Marbury Law Group, PLLC

(57) ABSTRACT

The present invention provides personalized experience based on the skin condition of each user. A cosmetic device according to the embodiments of the present application includes: a detachable component including a magnetic portion, a magnetic sensor for outputting a signal depending on magnetism of the magnetic portion, and a control circuit for driving the component by controlling a motor depending on the signal.

13 Claims, 9 Drawing Sheets

(51) Int. Cl.
*A46B 13/00* (2006.01)
*A46B 7/04* (2006.01)

(52) U.S. Cl.
CPC ..... *A46B 13/026* (2013.01); *A46B 15/0026* (2013.01); *A46B 2200/102* (2013.01); *A46B 2200/1006* (2013.01)

(58) Field of Classification Search
CPC ..... H02P 3/00; H02P 7/00; H02P 5/00; H02P 7/06; H02K 29/08
USPC ..... 318/400.01, 700, 701, 727, 799, 400.37, 318/400.38, 800, 801, 432; 433/119, 86, 433/125
See application file for complete search history.

(56) References Cited

U.S. PATENT DOCUMENTS 7,521,927 B2 4/2009 Ku et al.
7,959,438 B2 * 6/2011 Feine ..... A61C 17/20 433/119
7,979,939 B2 * 7/2011 Hilscher ..... A61C 17/222 15/22.1
2003/0101526 A1 6/2003 Hilscher et al.

FOREIGN PATENT DOCUMENTS

GB 2382957 A 6/2003
KR 10-0936962 B1 1/2010
KR 10-2013-0112528 A 10/2013
KR 10-1370678 B1 3/2014
WO 02/071970 9/2002

OTHER PUBLICATIONS

Chinese Office Action for counterpart Application No. 201680056958.X, dated Mar. 5, 2019 (with translation).
Korean Office Action for counterpart Application No. 10-2018-7008151, dated Jul. 17, 2019 with English Translation.
Notice of Allowance for counterpart Korean Application No. 10-2018-7008151, dated Feb. 6, 2020, with Translation.

* cited by examiner

COSMETIC DEVICE

CROSS REFERENCE TO RELATED APPLICATIONS

This is a national stage application of PCT/JP2016/074571, filed internationally on Aug. 17, 2016, which claims priority to Japanese Application No. 2015-199211, filed on Oct. 7, 2015, both of which are incorporated by reference herein in their entireties.

TECHNICAL FIELD

The present disclosure relates to a cosmetic device.

BACKGROUND ART

Various kinds of cosmetic devices have been developed. For example, there is a brush in which a brush head can be detached from a body and changed to another brush head.

Conventionally, there has been demanded for highly convenient cosmetic devices for users.

DISCLOSURE OF INVENTION

The following description does not limit the scope of the present disclosure. In order to solve the above-mentioned problem, for example, the cosmetic device shown in the following embodiments may be used. For example, in an embodiment, a cosmetic device includes a detachable component having a magnetic portion, a magnetic sensor for outputting a signal depending on the magnetism of the magnetic portion, and a control circuit for driving the component by controlling a motor depending on the signal.

BEST MODE FOR CARRYING OUT THE INVENTION

Demands on cosmetic devices have diversified, and more personalized cosmetic devices have been developed, and there may be cases where suitable motion of the brush for cleansing differs depending on the material of the brush. Meanwhile, electrically-driven cleansing brushes include electrical components, while waterproofing is required. Accordingly, there may be cases where it is difficult to provide a complicated switch. Namely, the information exchange may be a problem for the sealed device because of electric shorts. On the other hand, the other available technologies such as RFID are expensive, and more complicated electric signal processing may need to be performed. The cosmetic device in the following embodiments enables, for example, delivering of brush information to a processor for individual movement, providing an inexpensive user interface, but high reliability, and making of a wireless connection between a brush module and a body to secure waterproof ability.

Figure 1:
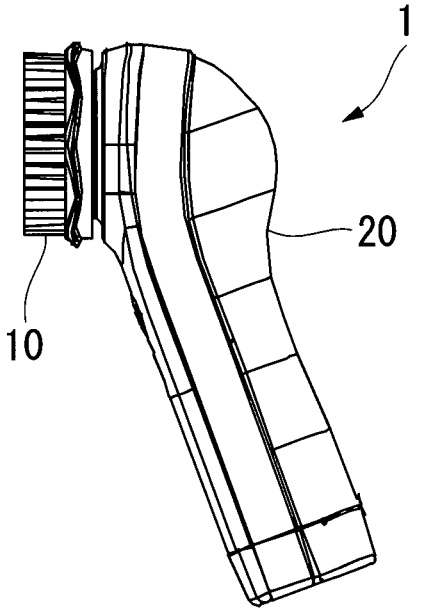
FIG. 1 illustrates a side view of a cosmetic device.

With reference to the figures, some embodiments will be explained in detail below. FIG. 1 illustrates a side view of a cosmetic device 1, in which one or more methodologies or technologies can be implemented such as, for example, delivering brush information to a processor. In an embodiment, the cosmetic device 1 includes an detachable component, for example, a brush module 10 and a body 20. In an embodiment, the cosmetic device 1 includes a brush driving part 100 inside the body 20. In an embodiment, during operation the brush driving part 100 moves, vibrates, or oscillates the brush module 10. For example, in an embodiment, the brush module 10 is repeatedly displaced in one direction and turning in the opposite direction. However, the movement of the brush module 10 is not limited to this simple back-and-forth motion, and motions such as rapidly drawing minute circles may be adopted. In an embodiment, motions such as rotating, tapping, etc. may also be adopted, and these kinds of motion and vibration may be combined. In an embodiment, the cosmetic device 1 is used for facial cleansing, massage, grinding, etc. by, for example, but not limited to, holding the body 20 with the hand and putting the vibrating brush module 10 on the face, head, elbow, knee, heel, etc.

Figure 2:
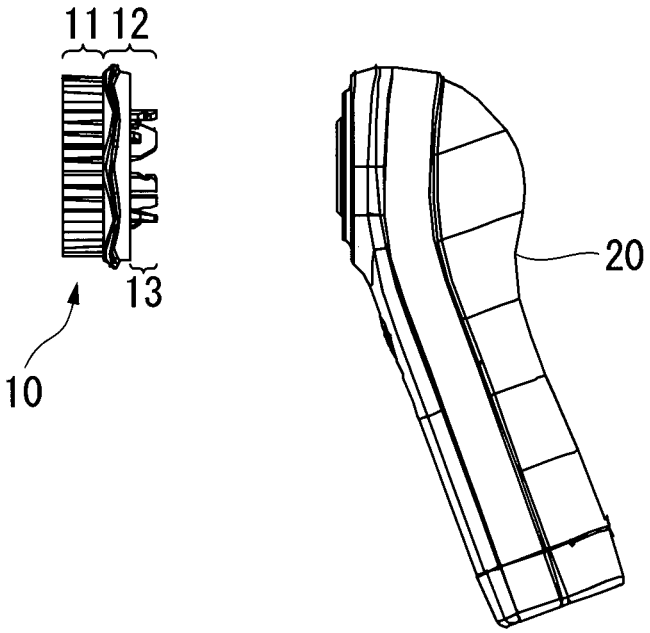
FIG. 2 illustrates a side view of a cosmetic device with a brush module 10 detached.
Figure 3:
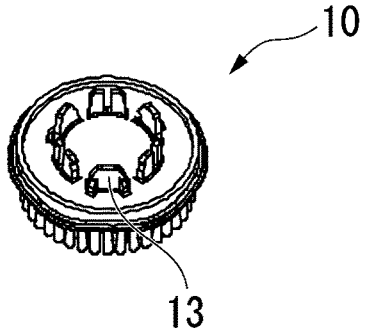
FIG. 3 illustrates the brush module 10 viewed from the side of a foot part 13.

As shown in FIG. 2, in an embodiment, the brush module 10 is detachable from the body 20. Bristles 11 are planted on one side of a base 12 of the brush module 10, and on the opposite side, the base 12 includes a foot part 13. In an embodiment, the bristles 11 are made of various kinds of materials such as natural sponge, nitrile rubber (NRB), urethane, silicon, pumice stone, plastic, or metal, etc. As shown in FIG. 3, in an embodiment, the foot part 13 stands in a circle, and detachably engages with projections 41 of a brush holder 40 shown in FIG. 4. In an embodiment, the brush module 10 is attached to the body 20 via one or more configurations. In an embodiment, one or more components of the cosmetic device 1 components are fabricated using polymeric material, elastomeric materials, plastic materials, and the like. For example, in an embodiment, the base 12 of the brush module 10 and the brush holder 40 of the body 20 are made from one or more of polymers, plastic, thermoplastics, elastomers, moldable materials, and the like.

Figure 4:
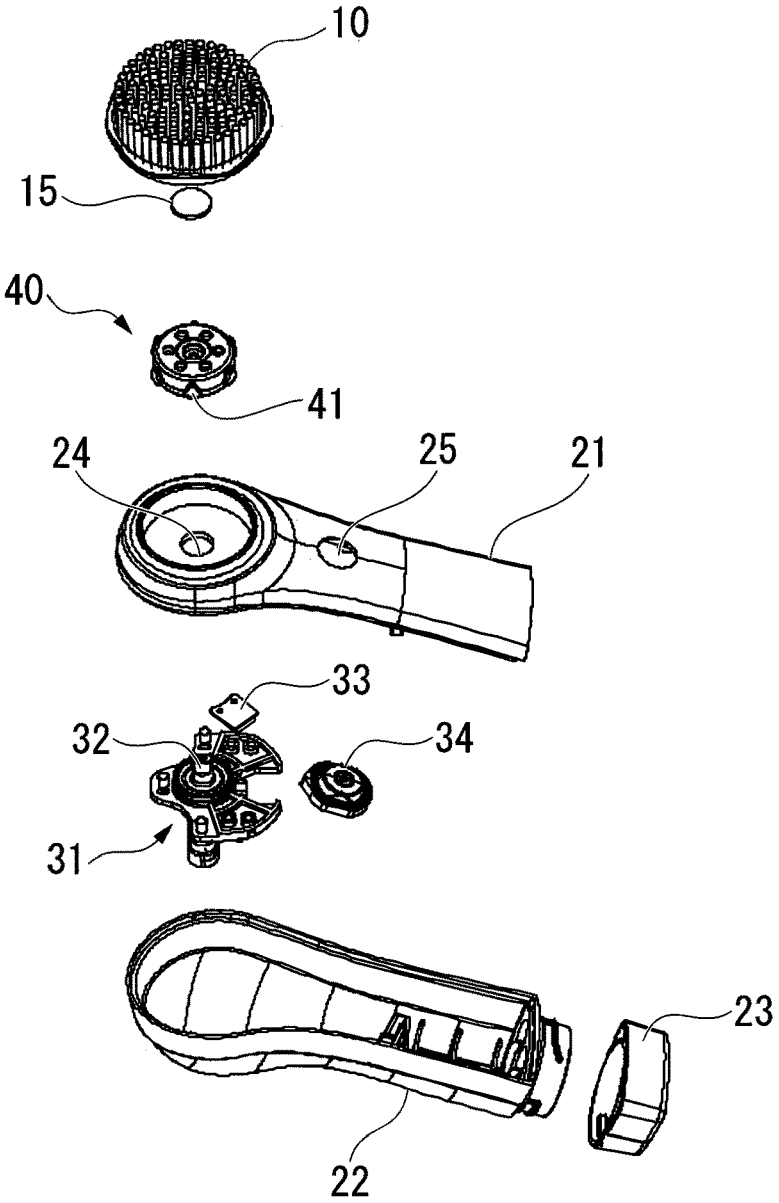
FIG. 4 illustrates major components of the cosmetic device 1.

FIG. 4 shows an exploded view of a cosmetic device 1 in which one or more methodologies or technologies can be implemented. In an embodiment, the above-mentioned brush driving part 100 inside the body 20 is not shown. In an embodiment, a casing of the body 20 is formed by a front casing 21, a rear casing 22, and a power source cap 23. The front casing 21, the rear casing 22, and the power source cap 23 are, for example, made of plastic. In an embodiment, the cosmetic device 1 includes one or more power sources 110. Non-limiting examples of power sources 110 include one or more button cells, chemical battery cells, a fuel cell, secondary cells, lithium ion cells, micro-electric patches, nickel metal hydride cells, silver-zinc cells, capacitors, super-capacitors, thin film secondary cells, ultra-capacitors, zinc-air cells, or the like. In an embodiment, the power source 110 includes at least one rechargeable power source. In an embodiment, the power source 110 includes one or more micro-batteries, printed micro-batteries, thin film batteries, fuel cells (e.g., biofuel cells, chemical fuel cells etc.), and the like.

In an embodiment, the power source cap 23 is used for putting in and taking out a power source 110 of the brush driving part 100. The front casing 21 has a hole 24 for connecting the brush driving part 100 to the brush holder 40 and a hole 25 for exposing a switch to the surface of the front casing 21, and the surrounding of the hole 24 is shaped in a hollow shape so as to accommodate the brush holder 40 with which the foot part 13 of the brush module 10 engages.

In an embodiment, a brush holder 40 has a round shape, and has projections 41 on the perimeter so that the foot part 13 (FIG. 3) of the brush module 10 detachably engages with the projections 41.

In an embodiment, a motor housing 31 is one of the components for fixing the motor 130 of the brush driving part 100 inside the body 20, and for example, is fixed to the front casing 21 or the rear casing 22 with screws. A rotatable axis 32 is provided in the longitudinal direction at the center of the motor housing 31, and the top of the axis 32 is connected to the center of the brush holder 40 through the hole 24 of the front casing 21.

Figure 7:
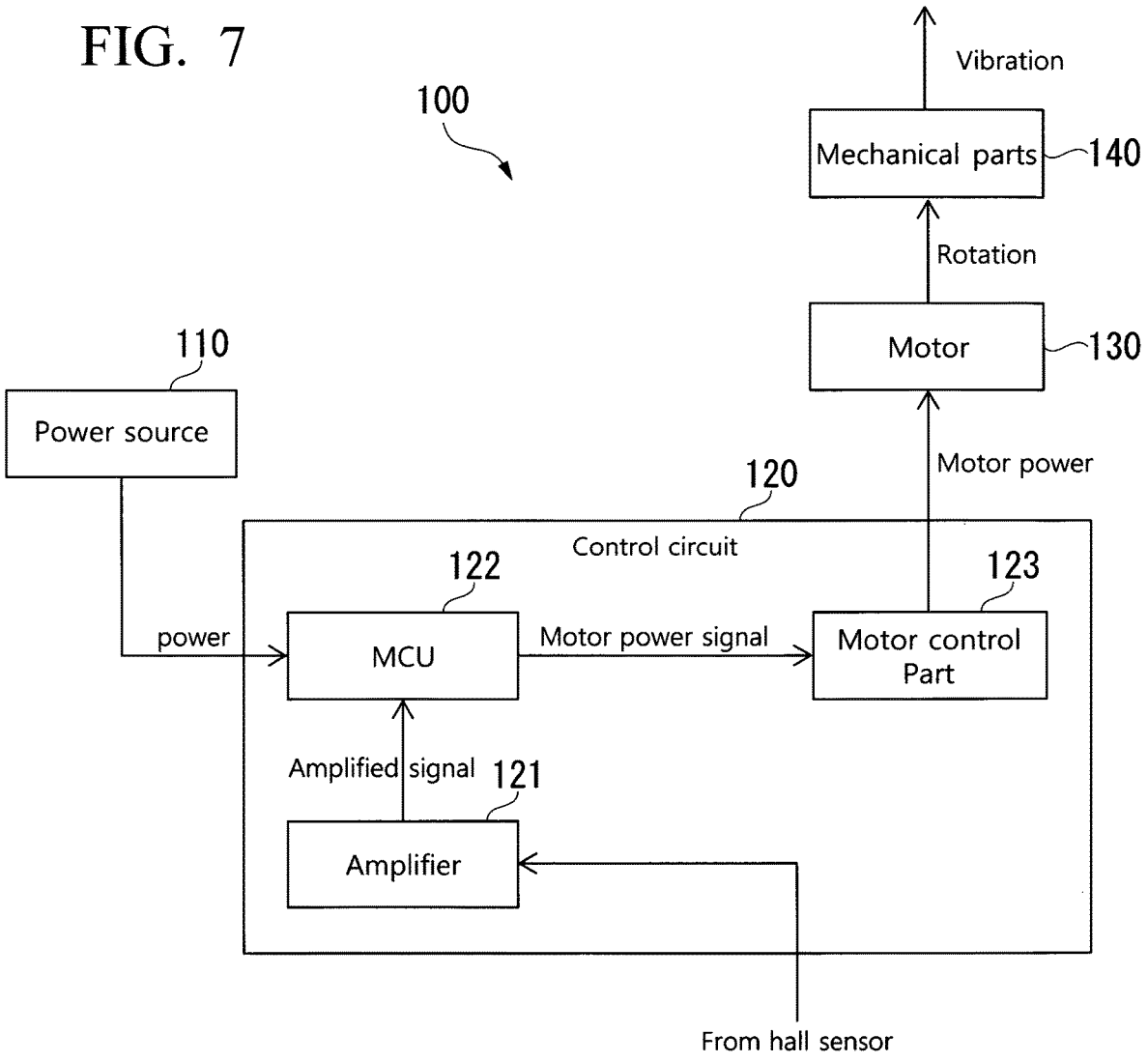
FIG. 7 illustrates a block diagram showing the constitution of the brush driving part 100.

Referring to FIG. 7, in an embodiment, the brush driving part 100 includes, as an example, a power source 110, a control circuit 120, a motor 130, and mechanical parts 140 for converting rotation of the motor 130 to vibration. As an example of the mechanical parts 140, an eccentric cam is attached to a rotation axis of the motor 130, the eccentric cam is put between two plates provided in the rotatable direction of the axis 32, and the two plates are fixed to the axis 32 with a support.

In an embodiment, the hole 25 of the front casing 21 is used for exposing a push switch for turning on and off the brush driving part 100 inside the body 20, to the surface of the front casing 21. For example, the push switch is fixed so that it can be pushed from outside the body 20 via rubber for waterproofing 34. Further, the brush driving part 100 may be arranged between the rubber for waterproofing 34 and the rear casing 22. Further, the motor 130 may be arranged between a board of the control circuit 120 of the brush driving part 100 and the rear casing 22.

Figure 5:
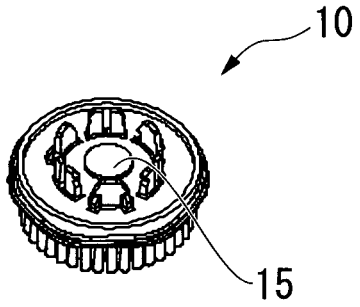
FIG. 5 illustrates the brush module 10 with a magnet 15 attached.

As shown in FIG. 5, in an embodiment, a magnetic portion, for example, a magnet 15 is attached at the center of the base 12 of the brush module 10. In an embodiment, the magnet 15 is a sintered magnet. In an embodiment, the magnet 15 is embedded in the brush module 10 so that it cannot be directly seen. In an embodiment, the magnet 15 is, for example, in the shape of a thin disk, wherein the polarities of two surfaces of the disk are opposite to each other.

Figure 6:
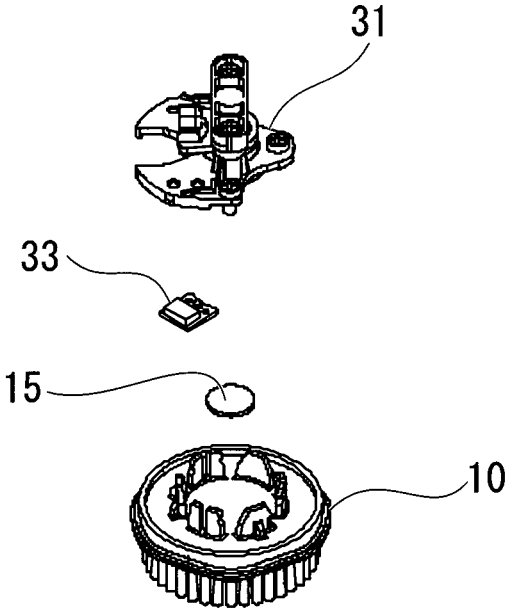
FIG. 6 illustrates part of components of the cosmetic device 1.

In an embodiment, a magnetic sensor for detecting magnetism, for example, a hall sensor 33 is provided on the back of the front casing 21 and near the hole 24 shown in FIG. 4. The hall sensor 33 may be arranged at a position on the upper side of the motor housing 31 and near the back of the front casing 21. The hall sensor 33 may also be placed inside the brush holder 40. As the magnetic sensor, a reed switch may be used, and an example of the constitution for this case will be mentioned later. Since the magnetism penetrates non-metal material, the hall sensor 33 detects the magnetism which is generated by the magnet 15 and passed through the brush holder 40 and the front casing 21. Since the mechanical parts 140 for converting rotation of the motor 130 to vibration are connected to the brush holder 40 via the axis 32 of the motor housing 31, in this embodiment, the hall sensor 33 is not located directly under the magnet 15, but is slightly displaced from the position directly under the magnet 15. FIG. 6 shows only the brush module 10, the magnet 15, the hall sensor 33, and the motor housing 31, upside down compared with FIG. 4.

FIG. 7 illustrates a block diagram showing the constitution of the brush driving part 100. In an embodiment, the brush driving part 100 includes, as an example, a power source 110, a control circuit 120, a motor 130, and mechanical parts 140 for converting the rotation of the motor 130 to vibration. A linear motor rather than a rotating motor, and mechanical parts for transmitting its motion to the brush holder 40 may be used. The control circuit 120 includes an amplifier 121, a micro controller unit (MCU) 122, and a motor control part 123.

In an embodiment, the power source 110 powers the MCU 122, etc. of the control circuit 120. In an embodiment, during operation, the amplifier 121 amplifies a signal received from the hall sensor 33, and outputs it to the MCU 122. The MCU 122 outputs a preprogrammed motor power signal based on the amplified signal to the motor control part 123. The motor control part 123 supplies predefined power to the motor 130 based on the motor power signal. The mechanical parts 140 convert the rotation of the motor 130 to vibration, and this vibration is transmitted to the brush holder 40 via the axis 32 of the motor housing 31.

Figure 8:
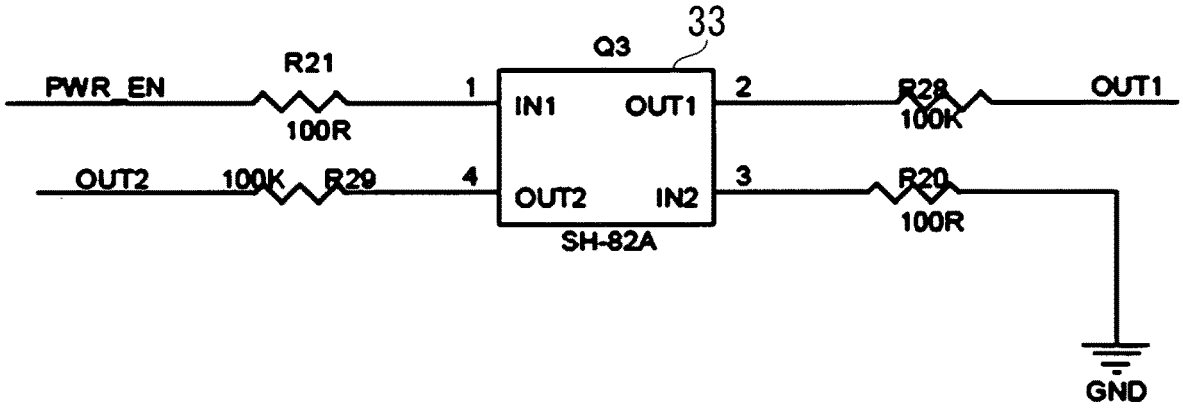
FIG. 8 illustrates an example of a circuit diagram around a hall sensor 33.
Figure 9:
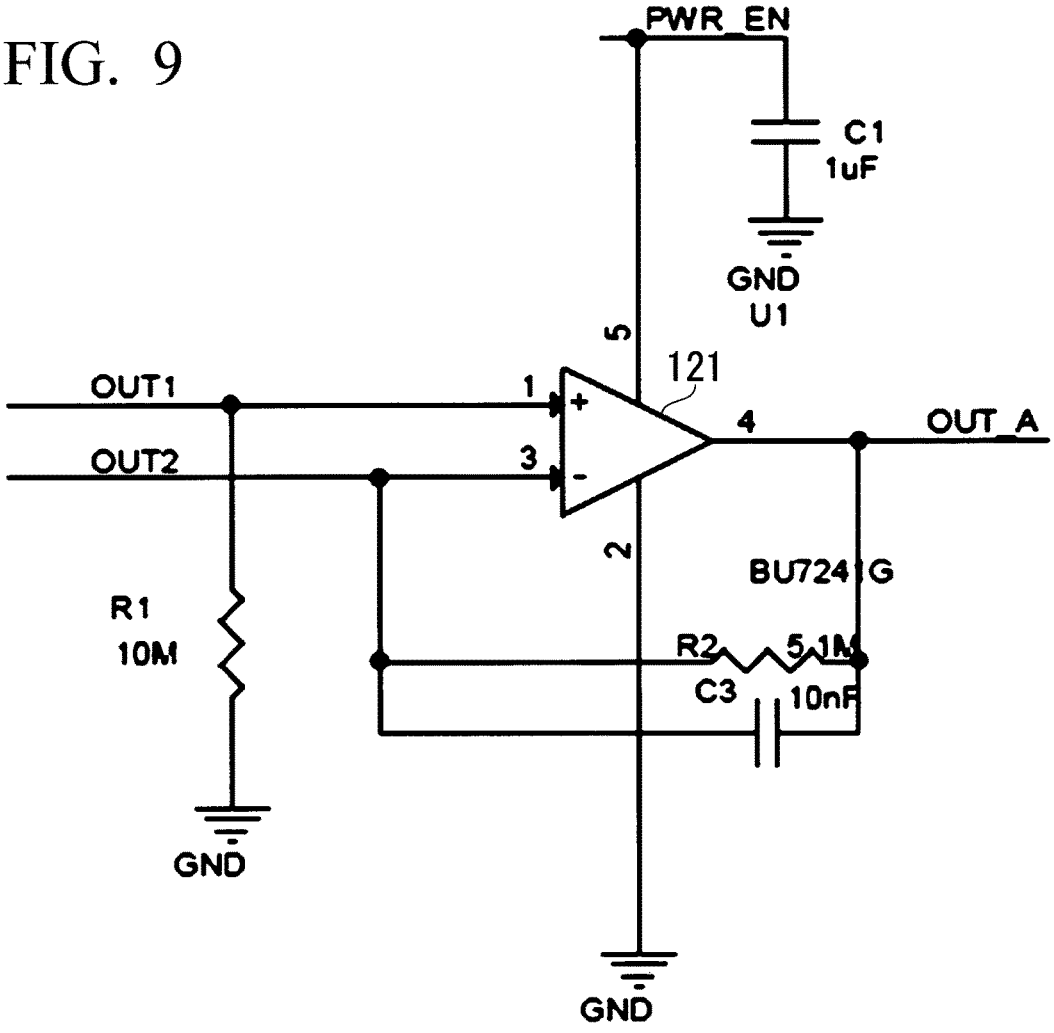
FIG. 9 illustrates an example of a circuit diagram around an amplifier 121.
Figure 10:
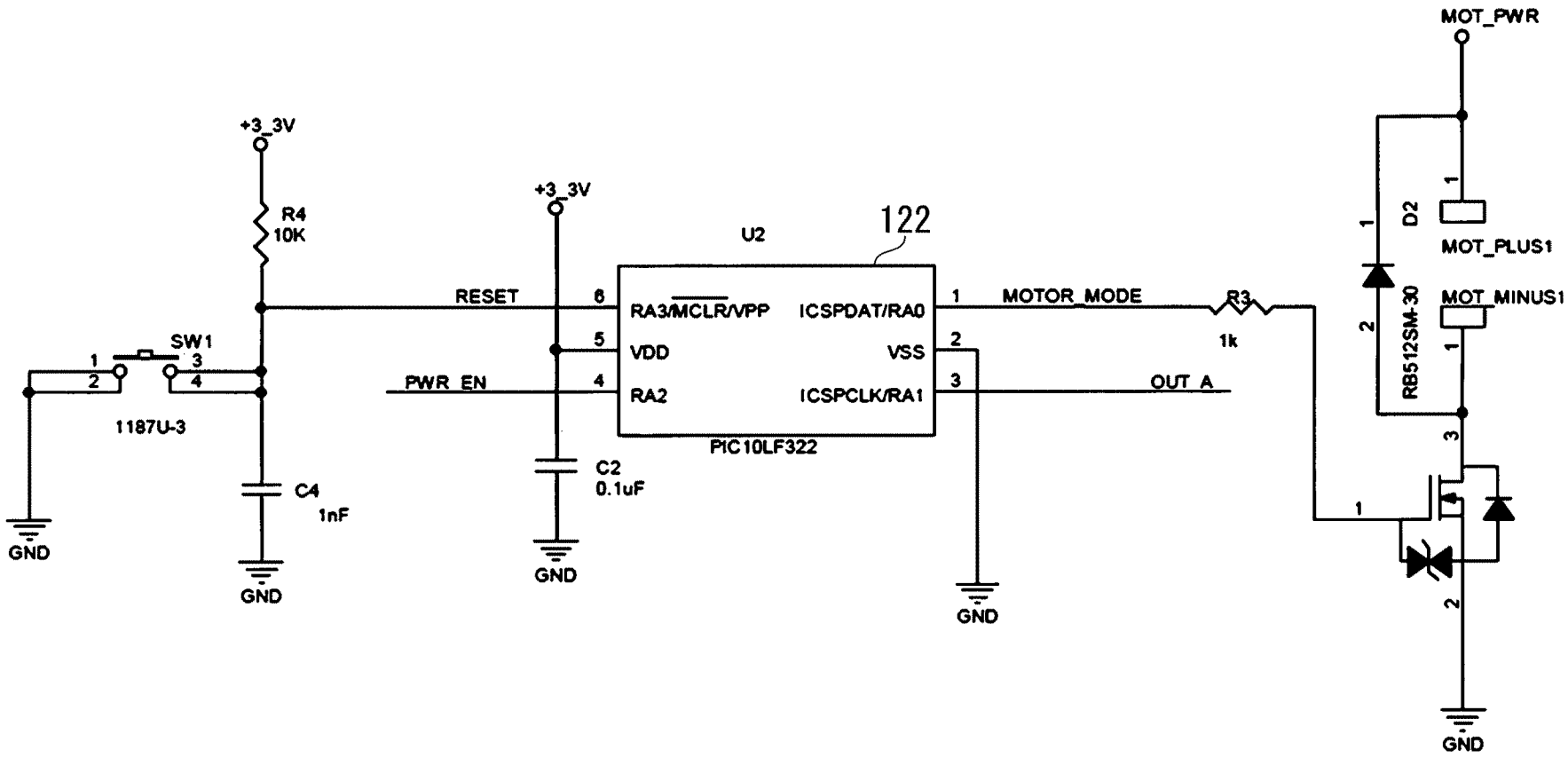
FIG. 10 illustrates an example of a circuit diagram around an MCU 122.
Figure 11:
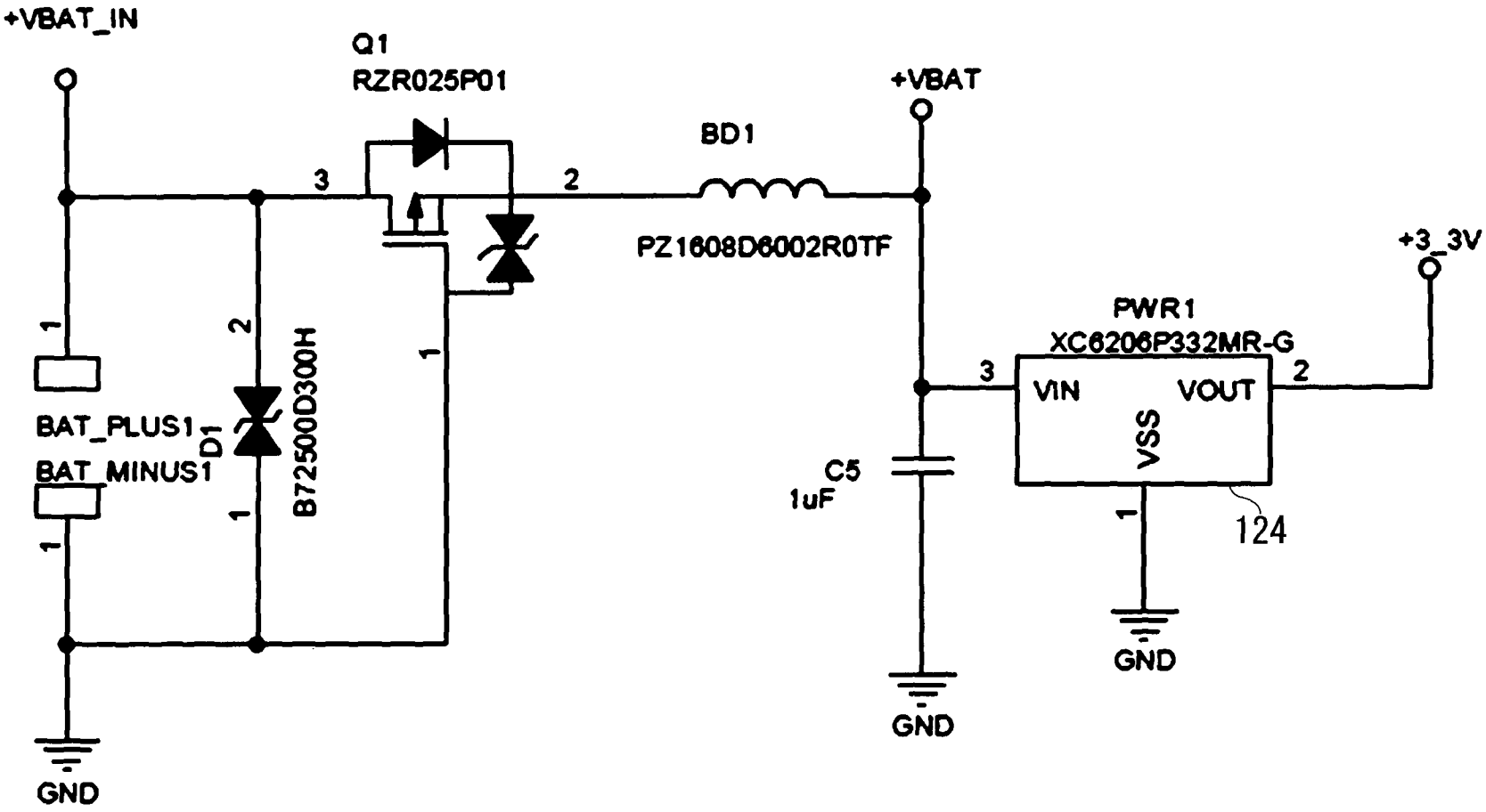
FIG. 11 illustrates an example of a power supply circuit for the MCU 122.
Figure 12:
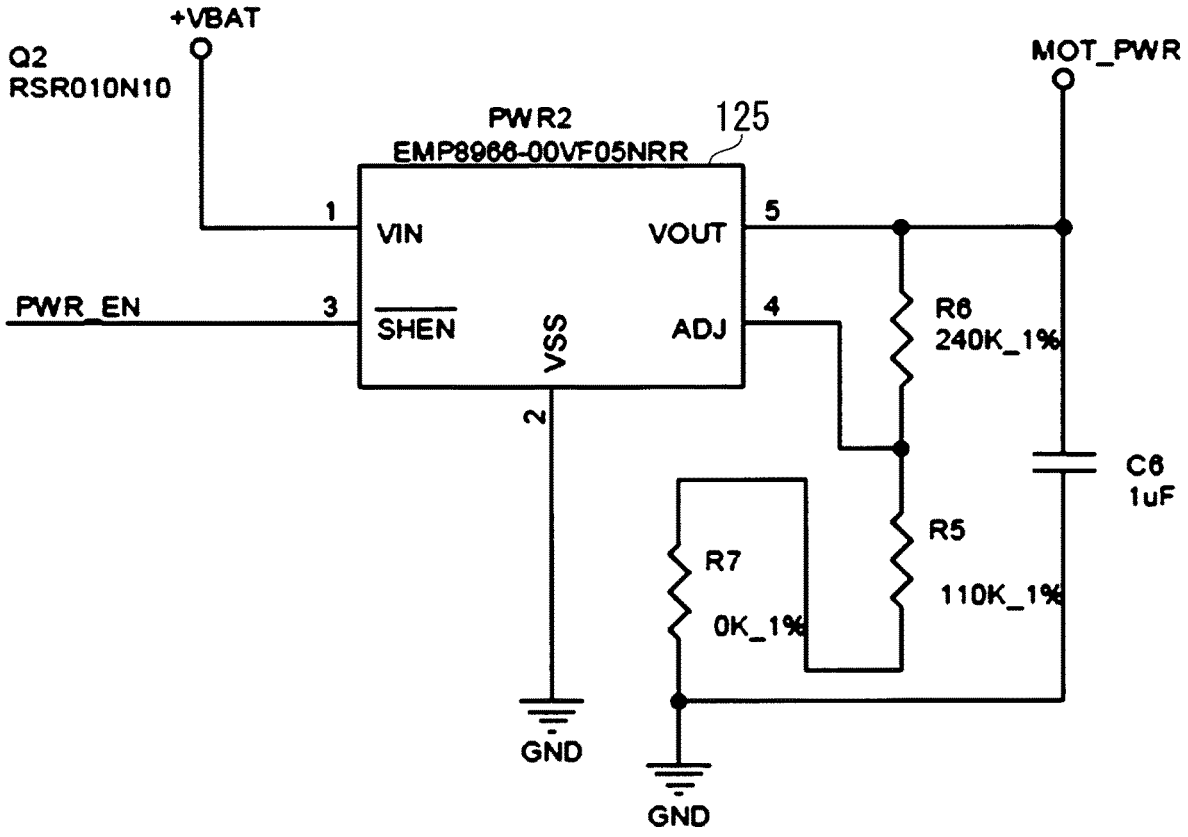
FIG. 12 illustrates an example of a power supply circuit for a motor 130.

FIGS. 8 to 12 illustrate examples of circuit diagrams around the hall sensor 33 in FIG. 4, the amplifier 121, the MCU 122, and the motor control part 123 in FIG. 7, which relate to detection of the magnetism and control of the motor 130. FIG. 8 shows an example of a circuit diagram around the hall sensor 33. Signals OUT1 and OUT2 output from terminals 2 and 4 of the hall sensor 33 via resistors are input into a non-inverted input terminal 1 and an inverted input terminal 3 of the amplifier 121 shown in FIG. 9, respectively, and a signal OUT_A output from an output terminal 4 of the amplifier 121 is input into a terminal 3 of the MCU 121 shown in FIG. 10. Namely, the signal OUT_A is a signal to which the difference between the signals OUT1 and OUT2 is amplified. For example, the MCU 121 is a programmable processor. The terminals denoted by +3_3V in FIG. 10 are connected to the terminal, which is connected to an output terminal 2 of a regulator 124 and denoted by +3_3V in FIG. 11, and the power generated from the power source 110 is supplied to the terminals denoted by +3_3V in FIG. 10. The MCU 122 in FIG. 10 determines a working mode based on the signal OUT_A, and outputs a signal MOTOR_MODE indicative of a mode from a terminal 1. For example, if OUT_A exceeds a positive threshold TH+, N polar is detected, if OUT_A falls below a negative threshold TH−, S polar is detected, and if OUT_A is between TH+ and TH−, the polarity is not detected. The relationship between the value of OUT_A and the polarity depends on the hall sensor 33, the amplifier 121, and the other circuit components. The terminal denoted by MOT_PWR is connected to the terminal, which is connected to an output terminal 5 of a regulator 125 and denoted by MOT_PWR in FIG. 12, and the power for the motor is supplied. Accordingly, the circuit shown in FIG. 10 is constituted so that the voltage applied to the motor 130 varies depending on the magnitude of the signal MOTOR_MODE.

In an embodiment, the movement of the brush module 10 can be changed depending on the type of the brush module 10 by only attaching the brush module 10 to the body 20 and turning on the switch on the body 20. Table 1 below shows an example of the relationships between the type of brush and the movement in a case where 3 kinds of magnetism can be detected as shown in the upper row.

TABLE 1

| Polarity | N polar | S polar | Non polar |
|---|---|---|---|
| Mode | 100% power | 80% power | No movement |
| Brush | (a) Normal brush | (b) Sensitive brush | (c) Forgery |

In this embodiment, it is assumed that there are three brush modules 10*a*, 10*b*, and 10*c*. According to Table 1, the brush module 10*a* has the bristles 11*a* with normal solidity, and the magnet 15 is attached in the direction in which N polar is detected. The brush module 10*b* has the bristles 11*b* with sensitive solidity compared with the brush module 10*a*, and the magnet 15 is attached in the direction in which S polar is detected. The magnet 15 is not attached to the brush module 10*c*, namely, the brush module 10*c* is not a genuine product. Further, it is assumed that the MCU 122 is pre-programmed so as to output the motor power signal for supplying 100% power to the motor 130 when N polar is detected, output the motor power signal for supplying 80% power to the motor 130 when S polar is detected, and output the motor power signal for not supplying power to the motor 130 (or not output the motor power signal) when the magnetism is not detected.

Figure 13:
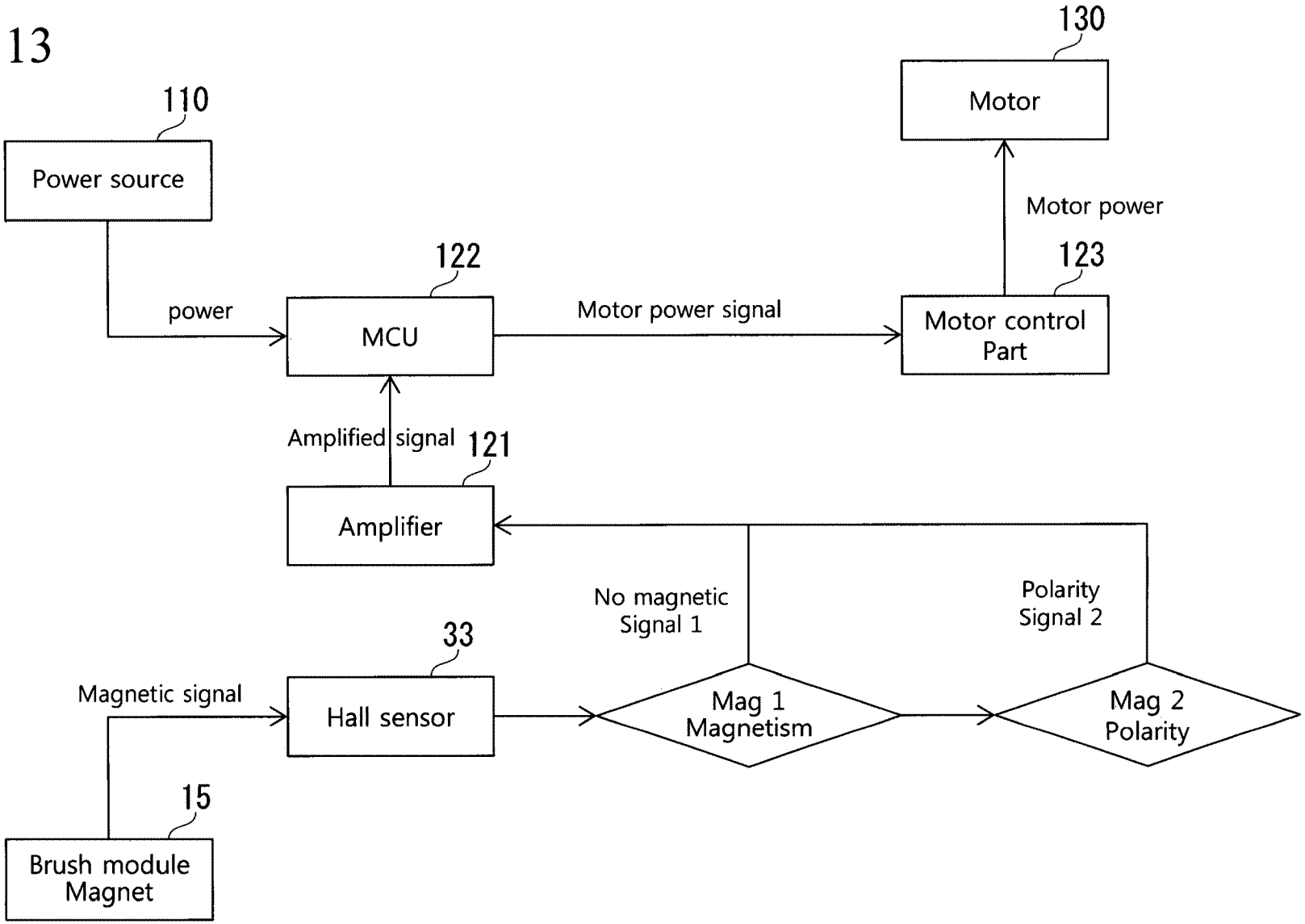
FIG. 13 illustrates a signal flow from detection of magnetism to control of the motor 130.

In the above-mentioned situation, with reference to FIG. 13, the signal flow from detection of the magnetism to control of the motor 130 will be explained below. The magnet 15 of the brush module 10 generates the magnetism, and depending on the magnetism, the hall sensor 33 outputs no magnetic signal 1 indicative of absence of the magnetism, or polarity signal 2N/S indicative of presence of the magnetism and the polarity (N polar or S polar) to the amplifier 121 (OUT_1 and OUT_2 in FIG. 8). Specifically, if the brush module 10*a* is attached to the body 20, the hall sensor 33 outputs the polarity signal 2N indicative of N polar, if the brush module 10*b* is attached to the body 20, the hall sensor 33 outputs the polarity signal 2S indicative of S polar, and if the brush module 10*c* is attached to the body 20, the hall sensor 33 outputs the no magnetic signal 1. The amplifier 121 amplifies the signal output from the hall sensor 33 to a suitable magnitude for processing at the MCU 122, and outputs to the MCU 122 (OUT_A obtained by amplifying the difference between OUT_1 and OUT_2 in FIG. 9). The MCU 122 determines a working mode based on the input signal, and outputs a motor power signal depending on the result of the determination to the motor control part 123 (MOTOR_MODE in FIG. 11). Specifically, if the signal indicative of N polar is input, the MCU 122 outputs the motor power signal for supplying 100% power, if the signal indicative of S polar is input, the MCU 122 outputs the motor power signal for supplying 80% power, and if the signal indicative of absence of the magnetism is input, the MCU 122 outputs the motor power signal for not supplying power (or does not output the motor power signal). The motor control part 123 supplies motor power to the motor 130 based on the received signal. The speed of the rotation of the motor 130 is changed depending on the supplied motor power, and thereby the speed of the vibration of the brush module 100 is changed.

In the embodiment above, whether or not the brush module 10 is a genuine product can be determined by detecting the presence of absence of the magnetism. Alternatively, if the magnetism is not detected, the power with percentages other than 100% and 80% may be supplied to the motor 130.

In the embodiment above, the mechanical parts 140 for converting the rotation of the motor 130 to vibration are used to vibrate the brush holder 10. The mechanical parts 140, which are constituted so that the brush module 10 makes the motion of rotating, tapping, etc., may be used. In this case, the speed of rotating, tapping, etc. of the brush module 10 is changed by controlling the motor power supplied to the motor 130.

In the embodiment above, the motion of the brush module 10 is changed by changing the power supplied to the motor. The motion of the brush module 10 may be changed by switching the mechanical movement, using a brush driving part 100 which is constituted so that the mechanical movement can be selected from among, for example, vibrating, tapping, etc.

Even if the power supplied to the motor is the same, stimuli to the human body differ if the kinds of the bristles 11 differ. Accordingly, the magnet 15 may be attached to the brush module 10 having the different kind of bristles 11 in the direction in which the same polarity is detected.

In the embodiment above, the working mode is determined based on the presence or absence of the magnetism and the polarity. Instead of the polarity or in addition to it, the working mode may be determined based on the strength of the magnetism. In this case, magnets, the strength of the magnetism of which differ, may be used, or the magnet 15 may be attached to the brush module 10 so that the distance between the hall sensor 33 and the magnet 15 is different from that of the other brush module 10. For example, if the absolute value |OUT_A| of the above-mentioned output signal OUT_A of the amplifier 122 exceeds a threshold $TH_1$, the magnetism is detected. For a threshold $TH_2$ which is greater than $TH_1$, if $|OUT_A|>TH_2$, 100% power is supplied to the motor 130, if $TH_1<|OUT_A|<=TH_2$, 80% power is supplied to the motor 130 and if $|OUT_A|<=TH_1$, 0% power is supplied to the motor 130. Further, more than two magnets and thresholds may be used.

As mentioned above, reed switches may be used instead of the hall sensor 33. Generally, a reed switch is turned on if the magnetism, the strength of which is within a predetermined range, is applied, and otherwise, turned off. An example of the constitution using reed switches is as follows: The magnets 15A and 15B, the strength of the magnetism of which differ, are attached to the brush modules 10A and 10B, respectively. The magnets 15A and 15B and the reed switches A and B are selected so that the reed switch A is turned on and the reed switch B is turned off if the brush module 10A is attached to the brush holder 40, and the reed switch A is turned off and the reed switch B is turned on if the brush module 10B is attached to the brush holder 40. The reed switches A and B are arranged at the same position where the hall sensor 33 is arranged. The control circuit 120 supplies 100% power to the motor 130 if the reed switch A is on, supplies 80% power to the motor 130 if the reed switch B is on, and does not supply power to the motor 130 if both of them are off. In this simple constitution, the MCU 122 or a processing unit is not required. Further, it is enough that the operations of the reed switches A and B for the magnets 15A and 15B differ in part. For example, the magnets 15A and 15B and the reed switches A and B may be selected so that the reed switch A is turned on and the reed switch B is turned off if the brush module 10A is attached to the brush holder 40, and the reed switches A and B are turned on if the brush module 10B is attached to the brush holder 40. Further, more than two magnets and reed switches may be used.

In the embodiments of the present application, the magnetism can penetrate non-metal material, no electrical constitution for obtaining a signal from the device outside is required, and thus it is quite useful for a waterproof device. Furthermore, the embodiments of the present application can provide a more specialized and personalized cleansing motion relatively inexpensively. The embodiments of the present application are applicable for a cosmetic device, for example, an electrically-driven cleansing brush, massager, etc.

The invention claimed is:

1. A cosmetic device comprising:

a detachable component comprising a magnetic portion;

magnetic sensor configured to generate a control signal responsive to detecting a magnetism of the magnetic portion; and a control circuit configured to generate a power control parameter for driving a motor, which is operably coupled to the component, responsive to detecting the magnetism of the magnetic portion.

2. The cosmetic device according to claim 1, wherein the control circuit comprises circuitry configured to generate the power control parameter based on a polarity of the magnetism.

3. The cosmetic device according to claim 2, wherein the control circuit is configured to generate a power control parameter for supplying a first power input to the motor when the polarity is N polar, and to generate a power control parameter for supplying a second power input to the motor when the polarity is S polar.

4. The cosmetic device according to claim 3, wherein the control circuit is configured to generate a power control parameter for supplying a third power input to the motor when the polarity is not detected.

5. The cosmetic device according to claim 4, wherein magnitude of the third power input is zero.

6. The cosmetic device according to claim 3, wherein magnitude of the first power input is different from that of the second power input.

7. The cosmetic device according to claim 2, wherein the control circuit comprises an amplifier, and wherein:

the magnetic sensor is configured to output a first output signal and a second output signal depending on the magnetism, the amplifier is configured to amplify a difference between the first output signal and the second output signal and to output a third output signal, and the control circuit is configured to input the third output signal from the amplifier and to determine the polarity based on the third output signal.

8. The cosmetic device according to claim 1, wherein the component is a brush.

9. The cosmetic device according to claim 1, wherein the magnetic portion is not detachable from the detachable component.

10. The cosmetic device according to claim 1, wherein when the component is attached to the cosmetic device, the magnetic portion is arranged at a position where the magnetic portion and the magnetic sensor are close.

11. The cosmetic device according to claim 1, wherein the control circuit is configured to generate a power control parameter for controlling driving of the component depending on the strength of the magnetism when the magnetism is detected.

12. A method of operating a cosmetic device, the cosmetic device comprising:

a detachable component comprising a magnetic portion;

a magnetic sensor configured to output a signal depending on magnetism of the magnetic portion; and a control circuit configured to drive the component by controlling a motor depending on the signal;

the method comprising:

generating a control signal responsive to detecting a magnetism of a magnetic portion of the detachable component; and generating a power control parameter for driving the motor, which is operably coupled to the component, responsive to detecting the magnetism of the magnetic portion of the detachable component.

13. A cosmetic device comprising:

circuitry configured to generate a control parameter responsive to detecting a magnetism of a magnetic portion of a detachable component; and circuitry configured to generate a power control parameter for driving a motor, which is operably coupled to the component, responsive to detecting the magnetism of the magnetic portion of the detachable component.

* * * * *